US010328320B2

(12) United States Patent
Goji et al.

(10) Patent No.: US 10,328,320 B2
(45) Date of Patent: Jun. 25, 2019

(54) GOLF CLUB GRIP AND GOLF CLUB

(71) Applicants: Dunlop Sports Co. Ltd., Kobe-shi, Hyogo (JP); Sumitomo Rubber Industries, Ltd., Kobe-shi, Hyogo (JP)

(72) Inventors: Sho Goji, Kobe (JP); Kazuyoshi Shiga, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/855,240

(22) Filed: Dec. 27, 2017

(65) Prior Publication Data

US 2018/0178097 A1 Jun. 28, 2018

(30) Foreign Application Priority Data

Dec. 28, 2016 (JP) ..... 2016-255777

(51) Int. Cl.
*A63B 53/14* (2015.01)

(52) U.S. Cl.
CPC ..... *A63B 53/14* (2013.01)

(58) Field of Classification Search
CPC ..... A63B 53/14; A63B 60/14
See application file for complete search history.

(56) References Cited

U.S. PATENT DOCUMENTS 4,552,713 A * 11/1985 Cavicchioli ..... A63B 53/14 264/162
5,322,290 A * 6/1994 Minami ..... A63B 53/14 473/201
6,817,954 B2 * 11/2004 Sano ..... A63B 53/14 473/282
7,582,352 B2 * 9/2009 Kobayashi ..... B32B 5/18 428/319.3
9,023,906 B2 * 5/2015 Okamoto ..... C08F 210/06 521/140
9,249,283 B2 * 2/2016 Heikkila ..... B60C 1/00
2006/0009304 A1 * 1/2006 Tremulis ..... A63B 53/14 473/300
2006/0128894 A1 * 6/2006 Nasreddine ..... C08K 5/14 525/178
2011/0240064 A1 * 10/2011 Wales ..... C09D 5/14 134/26
2015/0343750 A1 * 12/2015 Liu ..... B32B 27/32 156/185
2016/0136492 A1 5/2016 Mikura et al.
2016/0326351 A1 * 11/2016 Yalcin ..... C08L 23/0815

FOREIGN PATENT DOCUMENTS

JP 2016-093332 A 5/2016

* cited by examiner

*Primary Examiner* — Stephen L Blau
(74) *Attorney, Agent, or Firm* — Birch, Stewart, Kolasch & Birch, LLP

(57) ABSTRACT

An object of the present invention is to provide a golf club grip comprising a grip end with improved abrasion resistance and a reduced weight. The present invention provides a golf club grip comprising a cylindrical grip body and a grip end attached to a bat-side end of the cylindrical grip body, wherein the grip end comprises a base polymer and a hollow glass filler.

20 Claims, 2 Drawing Sheets

GOLF CLUB GRIP AND GOLF CLUB

FIELD OF THE INVENTION

The present invention relates to a golf club grip, and more specifically, relates to a technology for improving a grip end.

DESCRIPTION OF THE RELATED ART

A golf club comprises a shaft, a head provided on one end of the shaft, and a grip provided on another end of the shaft. A golf club having a small inertia moment exhibits a high head speed when it is swung, thereby providing a great flight distance when hitting the golf ball. Examples of the method for reducing the inertia moment of a golf club when it is swung include a method of reducing a weight of a grip.

Examples of the technology for reducing the weight of a golf club grip as well as improving the tensile strength of the golf club grip include Japanese Patent Publication No. 2016-93332 A. Japanese Patent Publication No. 2016-93332 A discloses a grip for sports goods comprising a cylindrical portion composed of a cylindrical inner layer and a cylindrical outer layer covering the inner layer, wherein the inner layer is a porous rubber layer or a porous resin layer, and the outer layer is formed from a rubber composition containing an acrylonitrile-butadiene based rubber.

SUMMARY OF THE INVENTION

A grip body is required to have strength or durability, and thus there is a limit to the reduction in the weight. In addition, if the weight of a grip end is also reduced by a conventional method of reducing the weight, the abrasion resistance of the grip end becomes insufficient. This is because when the golf club is put in a golf bag, the golf club is put in the golf bag with the grip end heading downward, and accordingly the grip end is required to have high level abrasion resistance. The present invention has been made in view of the abovementioned circumstances, and an object of the present invention is to provide a golf club grip comprising a grip end having a reduced weight without substantially lowering abrasion resistance.

The present invention that has solved the above problems provides a golf club grip comprising a cylindrical grip body and a grip end attached to a bat-side end of the cylindrical grip body, wherein the grip end comprises a base polymer and a hollow glass filler. The gist of the present invention resides in that the weight of the grip end is reduced without substantially lowering the abrasion resistance of the grip end by blending the hollow glass filler in the grip end.

The present invention also provides a golf club comprising a shaft, a head provided on one end of the shaft, and a grip provided on another end of the shaft, wherein the grip is the golf club grip according to the present invention.

According to the present invention, a golf club grip comprising a grip end having a reduced weight without substantially lowering abrasion resistance, is obtained.

DESCRIPTION OF THE PREFERRED EMBODIMENT

Figure 1:
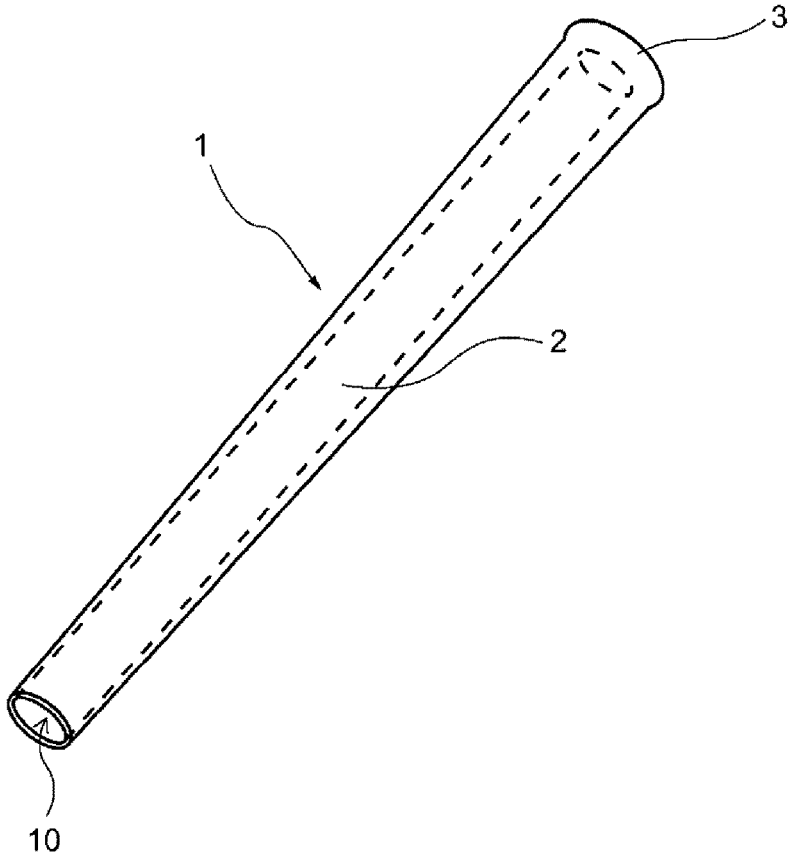
FIG. 1 is a perspective view showing one example of a golf club grip.

The present invention provides a golf club grip comprising a cylindrical grip body and a grip end attached to a bat-side end of the cylindrical grip body, wherein the grip end comprises a base polymer and a hollow glass filler. If the grip end comprises the hollow glass filler, the weight of the grip end is reduced without substantially lowering the abrasion resistance of the grip end.

The grip end of the golf club grip according to the present invention is preferably formed from a grip end composition comprising a base polymer and a hollow glass filler. The grip end composition preferably comprises, for example, a thermoplastic resin or a rubber as the base polymer.

Examples of the thermoplastic resin include thermoplastic resins such as an ionomer resin, a thermoplastic olefin copolymer, a thermoplastic polyurethane resin, a thermoplastic polyamide resin, a thermoplastic styrene resin, a thermoplastic polyester resin, and a thermoplastic acrylic resin. Among the thermoplastic resins, a thermoplastic elastomer having a rubber elasticity is preferred. Examples of the thermoplastic elastomer include a thermoplastic polyurethane elastomer, a thermoplastic polyamide elastomer, a thermoplastic styrene elastomer, a thermoplastic polyester elastomer, and a thermoplastic acrylic elastomer.

Examples of the rubber include natural rubber (NR), ethylene-propylene-diene rubber (EPDM), butyl rubber (IIR), acrylonitrile-butadiene rubber (NBR), hydrogenated acrylonitrile-butadiene rubber (HNBR), carboxyl-modified acrylonitrile-butadiene rubber (XNBR), butadiene rubber (BR), styrene-butadiene rubber (SBR), polyurethane rubber (PU), isoprene rubber (IR), chloroprene rubber (CR), and ethylene-propylene rubber (EPM). Among them, preferable examples of the base rubber include NR, EPDM, IIR, NBR, HNBR, XNBR, BR, SBR and PU.

The grip end composition preferably comprises a crosslinking agent. As the crosslinking agent, a sulfur based crosslinking agent and an organic peroxide may be used. Examples of the sulfur based crosslinking agent include an elemental sulfur and a sulfur donor type compound. Examples of the elemental sulfur include powdery sulfur, precipitated sulfur, colloidal sulfur, and insoluble sulfur. Examples of the sulfur donor type compound include 4,4'-dithiobismorpholine. Examples of the organic peroxide include dicumyl peroxide, $\alpha,\alpha'$-bis(t-butylperoxy-m-diisopropyl) benzene, 2,5-dimethyl-2,5-di(t-butylperoxy) hexane, and 1,1-bis(t-butylperoxy)-3,3,5-trimethylcyclohexane. The crosslinking agent may be used solely, or two or more of them may be used in combination. As the crosslinking agent, the sulfur based crosslinking agent is preferred, and the elemental sulfur is more preferred. The amount of the crosslinking agent is preferably 0.2 part by mass or more, more preferably 0.4 part by mass or more, and even more preferably 0.6 part by mass or more, and is preferably 4.0 parts by mass or less, more preferably 3.5 parts by mass or less, and even more preferably 3.0 parts by mass or less, with respect to 100 parts by mass of the base rubber.

The grip end composition preferably further comprises a vulcanization accelerator or a vulcanization activator.

Examples of the vulcanization accelerator include thiurams such as tetramethylthiuram disulfide (TMTD), tetramethylthiuram monosulfide (TMTM) and dipentamethylenethiuram tetrasulfide; guanidines such as diphenylguanidine (DPG); dithiocarbamates such as zinc dimethyldithiocarbamate (ZnPDC) and zinc dibutyldithiocarbamate; thioureas such as trimethylthiourea and N,N'-diethylthiourea; thiazoles such as mercaptobenzothiazole (MBT) and benzothiazole disulfide; and sulfenamides such as N-cyclohexyl-2-benzothiazolylsulfenamide (CBS) and N-t-butyl-2-benzothiazolylsulfenamide (BBS). These vulcanization accelerators may be used solely, or two or more of them may be used in combination. The amount of the vulcanization accelerator is preferably 0.4 part by mass or more, more preferably 0.8 part by mass or more, and even more preferably 1.2 parts by mass or more, and is preferably 8.0 parts by mass or less, more preferably 7.0 parts by mass or less, and even more preferably 6.0 parts by mass or less, with respect to 100 parts by mass of the base rubber.

Examples of the vulcanization activator include a metal oxide, a metal peroxide, and a fatty acid. Examples of the metal oxide include zinc oxide, magnesium oxide, and lead oxide. Examples of the metal peroxide include zinc peroxide, chromium peroxide, magnesium peroxide, and calcium peroxide. Examples of the fatty acid include stearic acid, oleic acid, and palmitic acid. These vulcanization activators may be used solely, or two or more of them may be used in combination. The amount of the vulcanization activator is preferably 0.5 part by mass or more, more preferably 0.6 part by mass or more, and even more preferably 0.7 part by mass or more, and is preferably 10.0 parts by mass or less, more preferably 9.5 parts by mass or less, and even more preferably 9.0 parts by mass or less, with respect to 100 parts by mass of the base rubber.

The grip end composition further comprises a hollow glass filler as a reinforcing material. The hollow glass filler used in the present invention is not particularly limited as long as the hollow glass filler is a hollow particle made of glass. The hollow glass filler is excellent in strength. Thus, when the grip end composition is prepared, the probability that the hollow glass filler is broken is low, and thus reducing of the weight can be efficiently performed. The glass composition of the hollow glass filler is preferably, but not limited to, for example, a soda lime borosilicate glass. In addition, the particle shape of the hollow glass filler is preferably spherical.

The pressure resistance strength of the hollow glass filler is preferably 100 MPa or more, more preferably 110 MPa or more, and even more preferably 120 MPa or more. If the pressure resistance strength of the hollow glass filler falls within the above range, the probability that the hollow glass filler is broken is lowered when preparing the grip end composition, and as a result, the effect of reducing the weight of the grip end is greater.

The particle size of the hollow glass filler is preferably 16 μm or more and 65 μm or less, more preferably 45 μm or less, and even more preferably 35 μm or less in a volume median particle size. If the particle size of the hollow glass filler falls within the above range, the hollow glass filler is easily handled, and the pressure resistance strength of the grip end can be kept.

The true density of the hollow glass filler is preferably 0.4 $g/cm^3$ or more, more preferably 0.5 $g/cm^3$ or more, and even more preferably 0.6 $g/cm^3$ or more, and is preferably less than 0.8 $g/cm^3$, more preferably 0.75 $g/cm^3$ or less, and even more preferably 0.7 $g/cm^3$ or less. If the true density of the hollow glass filler falls within the above range, the hollow glass filler is easily handled, and the effect of reducing the weight of the grip end is greater.

The grip end (grip end composition) of the golf club grip according to the present invention comprises the hollow glass filler preferably in an amount of 20 parts by mass or more, more preferably in an amount of 30 parts by mass or more, and even more preferably in an amount of 40 parts by mass or more, and preferably in an amount of less than 60 parts by mass, more preferably in an amount of 55 parts by mass or less, and even more preferably in an amount of 50 parts by mass or less, with respect to 100 parts by mass of the base polymer. If the amount of the hollow glass filler falls within the above range, the hardness required by the end cap can be achieved, and the kneading of the grip end composition also becomes easier.

The grip end composition may further comprise carbon black or silica. The amount of the carbon black or silica is preferably 0.1 part by mass or more, more preferably 3 parts by mass or more, and even more preferably 5 parts by mass or more, with respect to 100 parts by mass of the base polymer. If the amount of the carbon black or silica is 0.1 part by mass or more, the reinforcing effect is greater. In addition, from the viewpoint of reducing the weight of the grip end, the amount of the carbon black or silica is preferably 20 parts by mass or less, more preferably 15 parts by mass or less, and even more preferably 10 parts by mass or less, with respect to 100 parts by mass of the base polymer.

The grip end composition may further comprise an antioxidant, a softening agent, a vulcanization retardant, a coloring agent or the like, where necessary.

Examples of the antioxidant include imidazoles, amines and phenols. Examples of the imidazoles include nickel dibutyldithiocarbamate (NDIBC), 2-mercaptobenzimidazole, and zinc salt of 2-mercaptobenzimidazole. Examples of the amines include phenyl-α-naphtylamine. Examples of the phenols include 2,2'-methylene bis(4-methyl-6-t-butylphenol) (MBMBP), and 2,6-di-tert-butyl-4-methylphenol. These antioxidants may be used solely, or two or more of them may be used in combination. The amount of the antioxidant is preferably 0.2 part by mass or more, more preferably 0.3 part by mass or more, and even more preferably 0.4 part by mass or more, and is preferably 5.0 parts by mass or less, more preferably 4.8 parts by mass or less, and even more preferably 4.6 parts by mass or less, with respect to 100 parts by mass of the base polymer.

Examples of the softening agent include a mineral oil and a plasticizer. Examples of the mineral oil include a paraffin oil, a naphthene oil, an aromatic oil, and a process oil. Examples of the plasticizer include dioctyl phthalate, dibutyl phthalate, dioctyl sebacate, and dioctyl adipate.

The grip end composition may be prepared by a conventional method. For example, the grip end composition may be prepared by kneading raw materials with a kneading machine such as a Banbury mixer, a kneader, and an open roll. The temperature (material temperature) when performing the kneading preferably ranges from 90° C. to 160° C.

The grip composition constituting the cylindrical grip body according to the present invention will be explained. The cylindrical grip body is preferably formed from a grip composition comprising, for example, a thermoplastic resin or a rubber as a base polymer.

Examples of the thermoplastic resin include thermoplastic resins such as an ionomer resin, a thermoplastic olefin copolymer, a thermoplastic polyurethane resin, a thermoplastic polyamide resin, a thermoplastic styrene resin, a thermoplastic polyester resin, and a thermoplastic acrylic resin. Among the thermoplastic resins, a thermoplastic elastomer having a rubber elasticity is preferred. Preferable examples of the thermoplastic elastomer include a thermoplastic polyurethane elastomer, a thermoplastic polyamide elastomer, a thermoplastic styrene elastomer, a thermoplastic polyester elastomer, and a thermoplastic acrylic elastomer.

Examples of the rubber include natural rubber (NR), ethylene-propylene-diene rubber (EPDM), butyl rubber (IIR), acrylonitrile-butadiene rubber (NBR), hydrogenated acrylonitrile-butadiene rubber (HNBR), carboxyl-modified acrylonitrile-butadiene rubber (XNBR), butadiene rubber (BR), styrene-butadiene rubber (SBR), polyurethane rubber (PU), isoprene rubber (IR), chloroprene rubber (CR), and ethylene-propylene rubber (EPM). Among them, preferable examples of the base rubber include NR, EPDM, IIR, NBR, HNBR, XNBR, BR, SBR and PU.

The grip composition preferably comprises the acrylonitrile-butadiene based rubber as the base rubber. If the acrylonitrile-butadiene based rubber is comprised, the grip has enhanced tensile strength, and better grip performance under a wet condition.

Examples of the acrylonitrile-butadiene based rubber include an acrylonitrile-butadiene rubber (NBR), a carboxyl-modified acrylonitrile-butadiene rubber (XNBR), a hydrogenated acrylonitrile-butadiene rubber (HNBR), and a carboxyl-modified hydrogenated acrylonitrile-butadiene rubber (HXNBR). The XNBR is a copolymer of a monomer having a carboxyl group, acrylonitrile and butadiene. The HNBR is a hydrogenated product of the acrylonitrile-butadiene rubber. The HXNBR is a hydrogenated product of a copolymer of a monomer having a carboxyl group, acrylonitrile and butadiene.

The grip composition may further comprise a rubber other than the acrylonitrile-butadiene based rubber as the base rubber. The amount of the acrylonitrile-butadiene based rubber in the base rubber is preferably 50 mass % or more, more preferably 60 mass % or more, and even more preferably 70 mass % or more. In addition, it is also preferred that the grip composition comprises only the acrylonitrile-butadiene based rubber as the base rubber.

In the NBR, XNBR, HNBR and HXNBR, the amount of the acrylonitrile is preferably 15 mass % or more, more preferably 18 mass % or more, and even more preferably 21 mass % or more, and is preferably 50 mass % or less, more preferably 45 mass % or less, and even more preferably 40 mass % or less. If the amount of the acrylonitrile is 15 mass % or more, the grip has better abrasion resistance, and if the amount of the acrylonitrile is 50 mass % or less, the grip has better touch feeling in a cold region or in winter.

In the HNBR and HXNBR, the amount of the double bond is preferably 0.09 mmol/g or more, more preferably 0.2 mmol/g or more, and is preferably 2.5 mmol/g or less, more preferably 2.0 mmol/g or less, and even more preferably 1.5 mmol/g or less. If the amount of the double bond is 0.09 mmol/g or more, vulcanization is easily carried out during molding and thus the grip has further enhanced tensile strength, and if the amount of the double bond is 2.5 mmol/g or less, the grip has better durability (weather resistance) and tensile strength. The amount of the double bond can be adjusted by the amount of the butadiene in the copolymer or the amount of the hydrogen added into the copolymer.

Examples of the monomer having a carboxyl group in the XNBR and HXNBR include acrylic acid, methacrylic acid, fumaric acid, and maleic acid. In the XNBR and HXNBR, the amount of the monomer having a carboxyl group is preferably 1.0 mass % or more, more preferably 2.0 mass % or more, and even more preferably 3.5 mass % or more, and is preferably 30 mass % or less, more preferably 25 mass % or less, and even more preferably 20 mass % or less. If the amount of the monomer having a carboxyl group is 1.0 mass % or more, the grip has better abrasion resistance, and if the amount of the monomer having a carboxyl group is 30 mass % or less, the grip has better touch feeling in a cold region or in winter.

In the XNBR and HXNBR, the amount of the carboxyl group is preferably 1.0 mass % or more, more preferably 2.0 mass % or more, and even more preferably 3.5 mass % or more, and is preferably 30 mass % or less, more preferably 25 mass % or less, and even more preferably 20 mass % or less. If the amount of the carboxyl group is 1.0 mass % or more, the grip has better abrasion resistance, and if the amount of the carboxyl group is 30 mass % or less, the grip has better touch feeling in a cold region or winter.

The grip composition comprises a crosslinking agent in addition to the base rubber. As the crosslinking agent, a sulfur based crosslinking agent and an organic peroxide may be used. Examples of the sulfur based crosslinking agent include an elemental sulfur and a sulfur donor type compound. Examples of the elemental sulfur include powdery sulfur, precipitated sulfur, colloidal sulfur, and insoluble sulfur. Examples of the sulfur donor type compound include 4,4'-dithiobismorpholine. Examples of the organic peroxide include dicumyl peroxide, α,α'-bis(t-butylperoxy-m-diisopropyl) benzene, 2,5-dimethyl-2,5-di(t-butylperoxy) hexane, and 1,1-bis(t-butylperoxy)-3,3,5-trimethylcyclohexane. The crosslinking agent may be used solely, or two or more of them may be used in combination. As the crosslinking agent, the sulfur based crosslinking agent is preferred, and the elemental sulfur is more preferred. The amount of the crosslinking agent is preferably 0.2 part by mass or more, more preferably 0.4 part by mass or more, and even more preferably 0.6 part by mass or more, and is preferably 4.0 parts by mass or less, more preferably 3.5 parts by mass or less, and even more preferably 3.0 parts by mass or less, with respect to 100 parts by mass of the base rubber.

The grip composition preferably further comprises a vulcanization accelerator or a vulcanization activator. Examples of the vulcanization accelerator include thiurams such as tetramethylthiuram disulfide (TMTD), tetrabenzylthiuram disulfide (TBzTD), tetramethylthiuram monosulfide (TMTM), and dipentamethylenethiuram tetrasulfide; guanidines such as diphenylguanidine (DPG); dithiocarbamates such as zinc dimethyldithiocarbamate (ZnPDC), and zinc dibutyldithiocarbamate; thioureas such as trimethylthiourea, and N,N'-diethylthiourea; thiazoles such as mercaptobenzothiazole (MBT), and benzothiazole disulfide; and sulfenamides such as N-cyclohexyl-2-benzothiazolylsulfenamide (CBS), and N-t-butyl-2-benzothiazolylsulfenamide (BBS). These vulcanization accelerators may be used solely, or two or more of them may be used in combination. The amount of the vulcanization accelerator is preferably 0.4 part by mass or more, more preferably 0.8 part by mass or more, and even more preferably 1.2 parts by mass or more, and is preferably 8.0 parts by mass or less, more preferably 7.0 parts by mass or less, and even more preferably 6.0 parts by mass or less, with respect to 100 parts by mass of the base rubber.

Examples of the vulcanization activator include a metal oxide, a metal peroxide, and a fatty acid. Examples of the metal oxide include zinc oxide, magnesium oxide, and lead oxide. Examples of the metal peroxide include zinc peroxide, chromium peroxide, magnesium peroxide, and calcium peroxide. Examples of the fatty acid include stearic acid, oleic acid, and palmitic acid. These vulcanization activators may be used solely, or two or more of them may be used in combination. The amount of the vulcanization activator is preferably 0.5 part by mass or more, more preferably 0.6 part by mass or more, and even more preferably 0.7 part by mass or more, and is preferably 10.0 parts by mass or less, more preferably 9.5 parts by mass or less, and even more preferably 9.0 parts by mass or less, with respect to 100 parts by mass of the base rubber.

The grip composition may further comprise a reinforcing material, an antioxidant, a softening agent, a coloring agent, an antiscorching agent or the like, where necessary.

Examples of the reinforcing material include carbon black and silica. The amount of the reinforcing material is preferably 2.0 parts by mass or more, more preferably 3.0 parts by mass or more, and even more preferably 4.0 parts by mass or more, and is preferably 50 parts by mass or less, more preferably 45 parts by mass or less, and even more preferably 40 parts by mass or less, with respect to 100 parts by mass of the base rubber.

Examples of the antioxidant include imidazoles, amines, phenols and thioureas. Examples of the imidazoles include nickel dibutyldithiocarbamate (NDIBC), 2-mercaptobenzimidazole, and zinc salt of 2-mercaptobenzimidazole. Examples of the amines include phenyl-α-naphtylamine. Examples of the phenols include 2,2'-methylene bis(4-methyl-6-t-butylphenol) (MBMBP), and 2,6-di-tert-butyl-4-methylphenol. Examples of the thioureas include tributyl thiourea, and 1,3-bis(dimethylaminopropyl)-2-thiourea. These antioxidants may be used solely, or two or more of them may be used in combination. The amount of the antioxidant is preferably 0.2 part by mass or more, more preferably 0.3 part by mass or more, and even more preferably 0.4 part by mass or more, and is preferably 5.0 parts by mass or less, more preferably 4.8 parts by mass or less, and even more preferably 4.6 parts by mass or less, with respect to 100 parts by mass of the base rubber.

Examples of the softening agent include a mineral oil and a plasticizer. Examples of the mineral oil include a paraffin oil, a naphthene oil, and an aromatic oil. Examples of the plasticizer include dioctyl phthalate, dibutyl phthalate, dioctyl sebacate, and dioctyl adipate.

Examples of the antiscorching agent include an organic acid and a nitroso compound. Examples of the organic acid include phthalic anhydride, pyromellitic anhydride, trimellitic anhydride, benzoic acid, salicylic acid, and malic acid. Examples of the nitroso compound include N-nitrosodiphenylamine, N-(cyclohexylthio) phthalimide, sulfonamide derivative, diphenyl urea, bis(tridecyl)pentaerythritol diphosphite, and 2-mercaptobenzimidazole.

The grip composition may be prepared by a conventional method. For example, the grip composition may be prepared by kneading raw materials with a kneading machine such as a Banbury mixer, a kneader, and an open roll. The temperature (material temperature) when performing the kneading preferably ranges from 70° C. to 160° C. It is noted that when the grip composition comprises microballoons which will be described later, the kneading is preferably performed at a temperature lower than the expansion starting temperature of the microballoons.

The cylindrical grip body of the golf club grip according to the present invention may be a single-layered structure or a multiple-layered structure. It is also preferred that at least one layer of the cylindrical grip body is a porous layer. For example, if at least one layer of the multiple-layered structure is a porous layer, the weight of the grip body can be further reduced.

Examples of the method for preparing the porous layer include a balloon foaming method, chemical foaming method, supercritical carbon dioxide injection molding method, salt extraction method, and solvent removing method. In the balloon foaming method, microballoons are included in the grip composition followed by expanding the microballoons by heating to perform foaming. In addition, expanded microballoons may be blended in the grip composition followed by molding the resultant composition. In the chemical foaming method, a foaming agent (such as azodicarbonamide, azobisisobutyronitrile, N,N'-dinitrosopentamethylene tetramine, p-toluenesulfonyl hydrazine, and p-oxybis(benzenesulfono hydrazide)) or a foaming auxiliary is included in the grip composition followed by generating a gas (such as carbon dioxide gas and nitrogen gas) by a chemical reaction to perform foaming. In the supercritical carbon dioxide injection molding method, the grip composition is impregnated with carbon dioxide being in a supercritical state at a high pressure followed by injecting the resultant grip composition at a normal pressure to gasify carbon dioxide and hence perform foaming. In the salt extraction method, an easily soluble salt (such as boric acid and calcium chloride) is included in the grip composition followed by dissolving and extracting the salt after the molding to form fine pores. In the solvent removing method, a solvent is included in the grip composition followed by removing the solvent after the molding to form fine pores.

When at least one layer of the cylindrical grip body is a porous layer, the porous layer is preferably a foamed layer formed from a grip composition comprising the acrylonitrile-butadiene based rubber and a foaming agent. In particular, the porous layer is preferably a foamed layer prepared by the balloon foaming method. In other words, the cylindrical porous layer is preferably a foamed layer formed from a grip rubber composition comprising microballoons. If the microballoons are used, the porous layer has a light weight while keeping the mechanical strength thereof. As the microballoons, any one of organic microballoons and inorganic microballoons may be used. Examples of the organic microballoons include hollow particles formed from a thermoplastic resin, and resin capsules encapsulating a hydrocarbon with a low boiling point in a shell formed from a thermoplastic resin. Specific examples of the resin capsules include Expancel available from Akzo Nobel Company, and Matsumoto Microsphere (registered trademark) available from Matsumoto Yushi Seiyaku Co., Ltd. Examples of the inorganic microballoons include hollow glass particles (such as silica balloons and alumina balloons), and hollow ceramic particles.

The volume average particle size of the resin capsules (before expansion) is preferably 5 μm or more, more preferably 6 μm or more, and even more preferably 9 μm or more, and is preferably 90 μm or less, more preferably 70 μm or less, and even more preferably 60 μm or less.

When the porous layer is prepared by the balloon foaming method, the amount of the microballoons in the grip composition is preferably 5 parts by mass or more, more preferably 8 parts by mass or more, and even more preferably 12 parts by mass or more, and is preferably 20 parts by mass or less, more preferably 18 parts by mass or less, and even more preferably 15 parts by mass or less, with respect to 100 parts by mass of the base material (base rubber or base resin). If the amount of the microballoons is 5 parts by mass or more, the effect of reducing the weight of the grip is greater, and if the amount of the microballoons is 20 parts by mass or less, lowering in the mechanical strength of the porous layer can be suppressed.

In addition, the foaming ratio of the porous layer prepared by the balloon foaming method is preferably 1.2 or more, more preferably 1.5 or more, and even more preferably 1.8 or more, and is preferably 5.0 or less, more preferably 4.5 or less, and even more preferably 4.0 or less. If the foaming ratio is 1.2 or more, the effect of reducing the weight of the grip is greater, and if the foaming ratio is 5.0 or less, lowering in the mechanical strength of the porous layer can be suppressed.

The porous layer may be formed from a grip composition comprising a base resin. Examples of the base resin include a polyurethane resin, a polystyrene resin, a polyethylene resin, a polypropylene resin, an ethylene-vinyl acetate copolymer resin, and a polyethylene terephthalate resin.

The outermost surface layer of the golf club grip body according to the present invention is preferably formed from a grip composition comprising the base rubber and a resin having a softening point in a range from 5° C. to 120° C. (hereinafter sometimes referred to as "low softening point resin"). If the resin having a softening point in a range from 5° C. to 120° C. is comprised in the grip composition constituting the outermost surface layer, the grip has further enhanced anti-slipping performance. When the grip body is a multi-layered structure, the outermost surface layer means a layer actually touched by the hand of the golfer, and when the grip body is a single-layered structure, the outermost surface layer means the single-layered grip body. It is noted that in the detailed description of the present invention, the grip composition constituting the outermost surface layer is sometimes simply referred to as "surface layer composition".

The low softening point resin has a softening point in a range from 5° C. to 120° C. The low softening point resin is sufficiently softened when kneading the rubber composition, and thus has good dispersibility in the base rubber. In addition, softening of the low softening point resin is suppressed even if the outermost surface layer is stored at room temperature after the outermost surface layer is formed from the surface layer rubber composition, and thus bleeding out of the low softening point resin on the outermost surface layer is prevented.

The softening point of the low softening point resin is more preferably 10° C. or more, and even more preferably 15° C. or more, and is more preferably 115° C. or less, even more preferably 110° C. or less, and most preferably 100° C. or less. The softening point of the resin can be measured with a ring and ball type softening point tester prescribed in JIS-K 6220-1 (2015).

The low softening point resin is at least one member selected from the group consisting of a hydrogenated rosin ester, a disproportionated rosin ester, an ethylene-vinyl acetate copolymer, a coumarone resin, a phenol resin, a xylene resin and a styrene resin. These low softening point resins may be used solely, or two or more of them may be used in combination.

The hydrogenated rosin ester and the disproportionated rosin ester are so-called stabilized rosin esters. The rosin is a natural resin containing abietic acid, neoabietic acid, palustric acid, pimaric acid, isopimaric acid and dehydroabietic acid. The rosin ester is an ester compound obtained by reacting the above rosin with an alcohol.

Examples of the alcohol include a monohydric alcohol such as n-octyl alcohol, 2-ethylhexyl alcohol, decyl alcohol, lauryl alcohol and stearyl alcohol; a dihydric alcohol such as ethylene glycol, diethylene glycol, polyethylene glycol, propylene glycol, dipropylene glycol, polypropylene glycol and neopentyl glycol; a trihydric alcohol such as glycerin and trimethylolpropane; a tetrahydric alcohol such as pentaerythritol and diglycerin; and a hexahydric alcohol such as dipentaerythritol and sorbitol. Among them, the polyhydric alcohol such as the dihydric alcohol or higher alcohol is preferred, and glycerin is more preferred.

The hydrogenated rosin ester is an ester compound in which the portion deriving from the rosin of the rosin ester is hydrogenated. The hydrogenated rosin ester may be obtained by hydrogenating the rosin followed by reacting the resultant hydrogenated rosin with the alcohol, or by reacting the rosin with the alcohol followed by hydrogenating the resultant rosin ester.

The disproportionated rosin ester is an ester compound in which the portion deriving from the rosin of the rosin ester is disproportionated. The disproportionated rosin ester may be obtained by disproportionating the rosin followed by reacting the resultant disproportionated rosin with the alcohol, or by reacting the rosin with the alcohol followed by disproportionating the resultant rosin ester.

The acid value of the hydrogenated rosin ester or disproportionated rosin ester is preferably 2 mgKOH/g or more, more preferably 4 mgKOH/g or more, and even more preferably 6 mgKOH/g or more, and is preferably 200 mgKOH/g or less, more preferably 180 mgKOH/g or less, and even more preferably 160 mgKOH/g or less. If the acid value is 2 mgKOH/g or more, the hydrogenated rosin ester or disproportionated rosin ester has better compatibility with the acrylonitrile-butadiene based rubber, and if the acid value is 200 mgKOH/g or less, the carboxyl group of the hydrogenated rosin ester or disproportionated rosin ester nearly has no influence on the vulcanization reaction of the base rubber.

A commercial product may be used as the hydrogenated rosin ester or disproportionated rosin ester, and examples of the commercial product include HARITACK SE10, PH, F85, F105 and FK100 (available from Harima Chemicals Group, Inc.).

The amount of the vinyl acetate in the ethylene-vinyl acetate copolymer is preferably 10 mass % or more, more preferably 12 mass % or more, and even more preferably 15 mass % or more, and is preferably 80 mass % or less, more preferably 75 mass % or less, and even more preferably 70 mass % or less. If the amount of the vinyl acetate is 10 mass % or more, the grip performance improvement effect of the outermost surface layer under a wet condition is greater, and if the amount of the vinyl acetate is 80 mass % or less, lowering in the abrasion resistance of the outermost surface layer is suppressed.

A commercial product may be used as the ethylene-vinyl acetate copolymer, and examples of the commercial product include Ultrasen (registered trademark) 680, 681, 720, 722, 750, 760 (available from Tosoh Corporation), and Levapren (registered trademark) 400, 450, 500, 600, 700, 800 (available from Lanxess Corporation).

The coumarone resin is a resin containing coumarone or a derivate thereof as a monomer component. As the coumarone resin, a coumarone-indene resin is preferred. The coumarone-indene resin is a copolymer comprising a coumarone or a derivate thereof and an indene or a derivate thereof as a monomer component in a total amount of 50 mass % or more in all monomer components. Examples of the coumarone or the derivate thereof include coumarone and methylcoumarone. The amount of the coumarone or the derivate thereof in all monomer components preferably ranges from 1 mass % to 20 mass %. Examples of the indene or the derivate thereof include indene and methylindene. The amount of the indene or the derivate thereof in all monomer components preferably ranges from 40 mass % to 95 mass %. The coumarone-indene resin may further comprise a monomer component other than the coumarone or the derivate and the indene or the derivate. Examples of the other monomer component include styrene, vinyl toluene, and dicyclopentadiene.

A hydroxyl group may be introduced in the coumarone-indene resin. In this case, the hydroxyl value of the coumarone-indene resin is preferably 10 mgKOH/g or more, more preferably 15 mgKOH/g or more, and even more preferably 20 mgKOH/g or more, and is preferably 150 mgKOH/g or less, more preferably 140 mgKOH/g or less, and even more preferably 130 mgKOH/g or less. If the hydroxyl value falls within the above range, the coumarone-indene resin has better compatibility with the base rubber.

A commercial product may be used as the coumarone-indene resin, and examples of the commercial product include Nittoresin (registered trademark) G-90 (available from Nitto Chemical Co., Ltd.), and NOVARES C10 (available from Rutgers Chemicals Corporation).

The low softening point resin preferably has an ester group in the molecule thereof. If the low softening point resin has an ester group, the low softening point resin has better dispersibility in the base rubber. It is noted that the hydrogenated rosin ester, the disproportionated rosin ester and the ethylene-vinyl acetate copolymer have an ester group in the molecule thereof.

When the base rubber comprises the carboxyl-modified acrylonitrile-butadiene rubber and/or the carboxyl-modified hydrogenated acrylonitrile-butadiene rubber, the low softening point resin preferably has no hydroxyl group in the molecule thereof. In addition, when the base rubber comprises the carboxyl-modified acrylonitrile-butadiene rubber and/or the carboxyl-modified hydrogenated acrylonitrile-butadiene rubber, the low softening point resin preferably has a carboxyl group in the molecule thereof.

The amount of the low softening point resin is preferably 2 parts by mass or more, more preferably 4 parts by mass or more, and even more preferably 5 parts by mass or more, and is preferably 40 parts by mass or less, more preferably 35 parts by mass or less, even more preferably 30 parts by mass or less, and most preferably 20 parts by mass or less, with respect to 100 parts by mass of the base rubber. If the amount of the low softening point resin is 2 parts by mass or more, the grip performance of the obtained grip under a wet condition is further enhanced, and if the amount of the low softening point resin is 40 parts by mass or less, lowering in the mechanical strength of the grip is suppressed, and thus the obtained grip has better durability.

The golf club grip according to the present invention comprises a cylindrical grip body and a grip end attached to a bat-side end of the cylindrical grip body. It is noted that in the golf club grip, a tip side means a front end side of the golf club (a side at which the head is provided), and a bat side means a back end side of the golf club (a side opposite to the side at which the head is provided).

The cylindrical grip body may be a single-layered structure or a multi-layered structure. For example, if at least one layer of the multi-layered structure is a porous layer, the weight of the grip body can be reduced.

Figure 2:
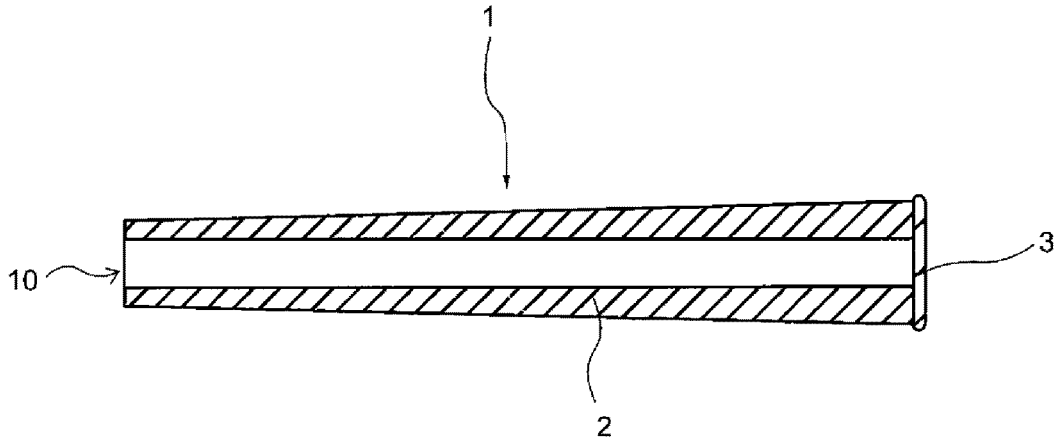
FIG. 2 is a cross-sectional view showing one example of a golf club grip.

Next, the golf club grip and the golf club will be explained with reference to figures. FIG. 1 is a perspective view showing one example of a golf club grip. FIG. 2 is a cross-sectional view showing one example of a golf club grip. A grip 1 comprises a cylindrical grip body 2 for inserting a shaft, and a grip end 3 provided on a bat-side end of the cylindrical grip body. The grip end 3 is provided to cover an opening of the cylindrical grip body 2 at the bat side. The golf club grip is provided on the shaft by inserting the shaft in an opening 10 of the golf club grip at the tip side.

Figure 3:
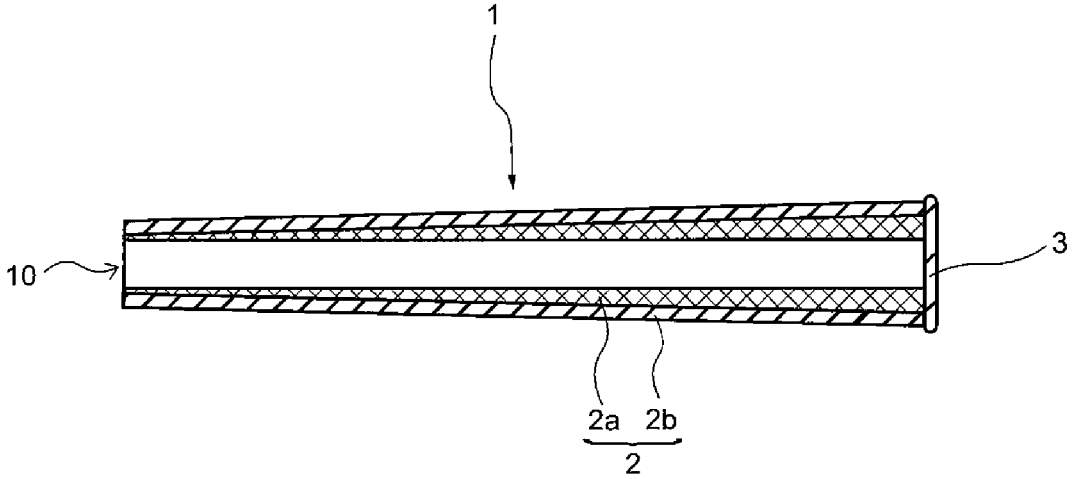
FIG. 3 is a cross-sectional view showing one example of a golf club grip.

FIG. 3 is a cross-sectional view showing another example of a golf club grip. The cylindrical grip body 2 is composed of a cylindrical inner layer 2*a* (hereinafter sometimes simply referred to as "inner layer") and a cylindrical outer layer 2*b* (hereinafter sometimes simply referred to as "outer layer") covering the cylindrical inner layer 2*a*. The cylindrical outer layer 2*b* is formed with a uniform thickness from the front end thereof toward the back end thereof. The inner layer 2*a* is formed with a thickness gradually becoming thicker from the front end thereof toward the back end thereof.

In FIG. 2 and FIG. 3, the left side along the paper surface is the tip side, and the right side along the paper surface is the bat side. The golf club grip is provided on the shaft by inserting the shaft in the opening 10 of the golf club grip at the tip side.

Examples of the shape of the grip end include, but are not limited to, a truncated cone, a hemisphere, and a disc. Among them, the grip end is preferably a disc shape. The diameter of the grip end with a disc shape is preferably 25 mm or more, more preferably 27 mm or more, and is preferably 31 mm or less, more preferably 29 mm or less. The thickness of the grip end with a disc shape is preferably 3 mm or more, more preferably 4 mm or more, and is preferably 6 mm or less, more preferably 5 mm or less.

The material hardness (JIS-A) of the grip end composition is preferably 60 or more, more preferably 65 or more, and even more preferably 70 or more, and is preferably 100 or less, more preferably 90 or less, and even more preferably 80 or less. If the material hardness (JIS-A) of the grip end composition falls within the above range, the mechanical strength of the grip end is further enhanced.

The density of the grip end of the golf club grip according to the present invention is preferably 0.4 g/cm$^3$ or more, more preferably 0.5 g/cm$^3$ or more, and even more preferably 0.6 g/cm$^3$ or more, and is preferably 1.0 g/cm$^3$ or less, more preferably 0.95 g/cm$^3$ or less, and even more preferably 0.90 g/cm$^3$ or less. If the density of the grip end falls within the above range, the effect of reducing the weight of the grip end is greater without substantially lowering the abrasion resistance of the grip end.

The mass of the grip end of the golf club grip according to the present invention is preferably 1.0 g or more, more preferably 1.5 g or more, and even more preferably 2.0 g or more, and is preferably 4.5 g or less, more preferably 4.0 g or less, and even more preferably 3.7 g or less. If the mass of the grip end falls within the above range, the effect of reducing the weight of the grip as a whole is obtained while keeping the mechanical strength of the end cap.

In the embodiment of FIG. 3, for example, if the cylindrical inner layer 2*a* is a porous layer, the weight of the grip body portion can be reduced. In addition, if the cylindrical inner layer 2*a* is a porous layer and the cylindrical outer layer 2*b* is a solid layer, the weight of the grip body portion can be reduced without substantially lowering the abrasion resistance of the grip. Further, if both of the cylindrical inner layer 2*a* and the cylindrical outer layer 2*b* are a porous layer, the weight of the grip body portion can be further reduced.

In a preferable embodiment of the present invention, the cylindrical outer layer 2*b* is preferably formed from a surface layer composition comprising a base rubber and a resin having a softening point in a range from 5° C. to 120° C. If the cylindrical outer layer 2*b* is formed from the surface layer composition comprising a resin having a softening point in a range from 5° C. to 120° C., the anti-slipping performance of the grip can be enhanced.

The thickness of the cylindrical grip body is preferably 0.5 mm or more, more preferably 1.0 mm or more, and even more preferably 1.5 mm or more, and is preferably 17.0 mm or less, more preferably 10.0 mm or less, and even more preferably 8.0 mm or less. The cylindrical grip body may be formed with a fixed thickness along the axis direction thereof, or with a thickness gradually becoming thicker from the front end thereof toward the back end thereof.

The outer layer and the inner layer may have a uniform thickness or a varied thickness. For example, the outer layer and the inner layer may be formed with a thickness gradually becoming thicker from one end toward another end along the axis direction of the cylindrical grip. The cylindrical outer layer preferably has a uniform thickness.

When the cylindrical grip body has a thickness in a range from 0.5 mm to 17.0 mm, the thickness of the outer layer is preferably 0.1 mm or more, more preferably 0.15 mm or more, and even more preferably 0.2 mm or more, and is preferably 2.5 mm or less, more preferably 2.0 mm or less, and even more preferably 1.5 mm or less. If the thickness of the outer layer is 0.1 mm or more, the reinforcing effect by the outer layer material becomes greater, and if the thickness of the outer layer is 2.5 mm or less, the inner layer can be relatively thickened and thus the effect of reducing the weight of the grip becomes greater.

The percentage ((thickness of outer layer/thickness of cylindrical grip body)×100) of the thickness of the outer layer to the thickness of the cylindrical grip body is preferably 0.5% or more, more preferably 1.0% or more, and even more preferably 1.5% or more, and is preferably 99.0% or less, more preferably 98.0% or less, and even more preferably 97.0% or less. If the above percentage is 0.5% or more, the reinforcing effect by the cylindrical outer layer material becomes greater, and if the above percentage is 99.0% or less, the inner layer can be relatively thickened and thus the effect of reducing the weight of the grip becomes greater.

The material hardness $H_{out}$ (JIS-A) of the grip composition constituting the outer layer is preferably 30 or more, more preferably 40 or more, and even more preferably 45 or more, and is preferably 80 or less, more preferably 70 or less, and even more preferably 60 or less. If the material hardness (JIS-A) of the outer layer grip composition is 30 or more, the mechanical strength of the outer layer is further enhanced, and if the material hardness (JIS-A) of the outer layer grip composition is 80 or less, the outer layer does not become excessively hard and thus the grip feeling when holding the grip becomes better.

The material hardness $H_{in}$ (JIS-A) of the grip composition constituting the inner layer is preferably 10 or more, more preferably 15 or more, and even more preferably 20 or more, and is preferably 80 or less, more preferably 70 or less, and even more preferably 60 or less. If the material hardness (JIS-A) of the inner layer grip composition is 10 or more, the inner layer does not become excessively soft and thus a tightly fixed touch feeling can be obtained when holding the grip, and if the material hardness (JIS-A) of the inner layer grip composition is 80 or less, the inner layer does not become excessively hard and thus the grip feeling when holding the grip becomes better.

The material hardness $H_{out}$ (JIS-A) of the grip composition constituting the outer layer is preferably equal to or greater than the material hardness $H_{in}$ (JIS-A) of the grip composition constituting the inner layer. In this case, the hardness difference ($H_{out}$–$H_{in}$) (JIS-A) is preferably 0 or more, more preferably 10 or more, and even more preferably 20 or more, and is preferably 65 or less, more preferably 60 or less, and even more preferably 55 or less. If the hardness difference ($H_{out}$–$H_{in}$) falls within the above range, the grip feeling when holding the grip becomes better.

In the golf club grip according to the present invention, examples of the combination of the outer layer and the inner layer include a combination of a solid outer layer and a porous inner layer, and a combination of a porous outer layer and a porous inner layer. In particular, when the outer layer and the inner layer are a foamed layer, the foaming ratio of the outer layer is preferably smaller than the foaming ratio of the inner layer. In addition, in this case, the ratio (inner layer/outer layer) of the foaming ratio of the inner layer to the foaming ratio of the outer layer is preferably 1.1 or more, more preferably 1.5 or more, and even more preferably 2.0 or more, and is preferably 10.0 or less, more preferably 9.0 or less, and even more preferably 8.0 or less.

The golf club grip according to the present invention may further comprise an intermediate layer disposed between the cylindrical inner layer and the cylindrical outer layer. If the intermediate layer is disposed, the freedom of designing the grip properties is enhanced. The intermediate layer may be disposed along the whole or part of the lengthwise direction of the grip (axis direction of the cylindrical portion). In addition, the intermediate layer may be a single layer, or two or more layers. The intermediate layer may be a solid layer or a porous layer. In addition, the material of the intermediate layer may be a rubber or a resin without any limitation, and the material same as the outer layer and the inner layer can be used.

[Adhesive Layer]

The golf club grip may further comprise an adhesive layer disposed between the layers of the inner layer, the intermediate layer and the outer layer. It is noted that the adhesive layer is a very thin layer with a thickness of 30 μm or less, and thus is a layer different from the intermediate layer. Examples of the adhesive constituting the adhesive layer include a vulcanized adhesive (crosslinked adhesive) and a rubber cement. If the adhesive layer is comprised, the peel strength between the inner layer and the outer layer is greater.

Examples of the cylindrical grip body of the golf club grip include a cylindrical grip body comprising a cylindrical inner layer and a cylindrical outer layer covering the inner layer; a cylindrical grip body comprising a cylindrical inner layer, a cylindrical outer layer covering the inner layer, and at least one intermediate layer disposed between the inner layer and the outer layer; and a cylindrical grip body comprising a cylindrical inner layer, a cylindrical outer layer covering the inner layer and an adhesive layer disposed between the inner layer and the outer layer.

The mass of the golf club grip according to the present invention is preferably 18 g or more, more preferably 20 g or more, and even more preferably 22 g or more, and is preferably 37 g or less, more preferably 28 g or less, and even more preferably 25 g or less. If the mass of the grip end falls within the above range, the head speed improvement effect by the reduced weight of the grip is obtained while keeping the strength required by the grip.

[Preparation Method]

The golf club grip according to the present invention is obtained, for example, by press molding an unvulcanized rubber sheet formed from the grip composition and the grip end formed from the grip end composition in a mold. Examples of the method of preparing the sheet from the grip composition include a press molding method and an injection molding method. In addition, the grip end may be in any state of an unvulcanized, partially vulcanized or fully vulcanized state. When the press molding method is adopted, the temperature of the mold preferably ranges from 140° C. to 200° C., the molding time preferably ranges from 5 minutes to 45 minutes, and the molding pressure preferably ranges from 0.1 MPa to 150 MPa. It is noted that in the case of preparing the foamed layer by the balloon foaming method, it is preferred that the balloons are not expanded when preparing the unvulcanized sheet and are expanded when press molding the sheet.

[Golf Club]

The present invention further provides a golf club comprising the golf club grip according to the present invention. The golf club comprises a shaft, a head provided on one end of the shaft, and a grip provided on another end of the shaft, wherein the grip is the golf club grip according to the present invention. The shaft can be made of stainless steel or a carbon fiber reinforcing resin. Examples of the head include a wood type, utility type, and iron type. The material constituting the head is not particularly limited, and examples thereof include titanium, titanium alloy, carbon fiber reinforcing plastic, stainless steel, maraging steel, and soft iron.

Figure 4:
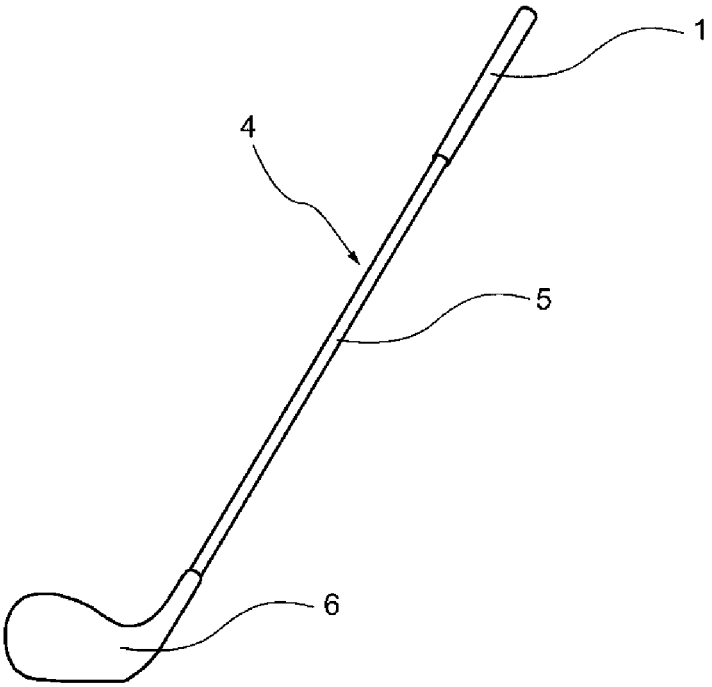
FIG. 4 is a perspective view showing one example of a golf club.

FIG. 4 is a perspective view showing one example of the golf club according to the present invention. A golf club 4 comprises a shaft 5, a head 6 provided on one end of the shaft 5, and a grip 1 provided on another end of the shaft 5. The back end of the shaft 5 is inserted into a cylindrical grip body 2 of the grip 1.

EXAMPLES

Next, the present invention will be described in detail by way of examples. However, the present invention is not limited to the examples described below, and various changes and modifications can be made in accordance with the spirit of the present invention and are all included in the technical scope of the present invention.

[Evaluation Method]

(1) Material Hardness (JIS-A)

Square sheets with a side length of 13 cm and a thickness of 2 mm were prepared by pressing the grip end composition or grip composition at 160° C. for 8 minutes. Square pieces with a side length of 2 cm were punched from the sheets, and three of the square pieces were stacked to prepare a test piece with a thickness of 6 mm. The hardness of the test piece was measured with a type P1 automatic rubber hardness tester available from Kobunshi Keiki Co., Ltd., provided with a type durometer prescribed in JIS K6253-3 (2012).

(2) Density

A square sheet with a side length of 13 cm and a thickness of 2 mm was prepared by pressing the grip end composition at 160° C. for 8 minutes. A square piece with a side length of 2 cm was punched from the sheet to prepare a test piece. The density of the obtained test piece was measured with an automatic densimeter (SP-GR1 available from MS-technical, Inc., based on Archimedes principle).

(3) Abrasion Resistance Test

A square sheet with a side length of 13 cm and a thickness of 2 mm was prepared by pressing the grip end composition at 160° C. for 8 minutes. The sheet was cut to prepare a test piece with a width of 4 cm, a length of 13 cm and a thickness of 2 mm. The abrasion resistance of the obtained test piece was evaluated based on the weight change of the test piece before and after an abrasion test performed using a Gakushin type color abrasion fastness tester (II type abrasion tester) available from Yasuda Seiki Seisakusho, Ltd. under the following testing conditions It is noted that the weight change of the grip end No. 7 was defined as an index of 100, and the abrasion resistance of each grip end is a value represented by converting the weight change of each grip end into this index.

(Testing Conditions)

Moving distance: 10 cm

Load: 196 N

Testing times: 500 times reciprocation

Sand paper: #240

(4) Pressure Resistance Strength of Hollow Glass Filler (MPa)

The pressure resistance strength of the hollow glass filler was measured according to "Hydrostatic Collapse Strength of Hollow Glass Microspheres" prescribed in ASTM D3102-72 except the following modification. The sample size (gram) was set to be equal to 10 folds of the density of the hollow glass filler. The hollow glass filler was dispersed in glycerol (20.6 g), and a computer software was used to automatically process data. The reported value was a hydrostatic pressure (90 endurance strength) when 10 volume percent of the hollow glass filler was broken.

(5) Median Particle Size of Hollow Glass Filler (50% Particle Size in Volume Cumulative Distribution, μm)

The volume median particle size was determined by measruing the hollow glass filler dispersed in a deaerated and deionized water by a laser diffraction method. As the laser diffraction particle size analyzer, for example, a laser diffraction particle size analyzer with a trade name of "SATURN DIGISIZER" available from Micromeritics can be used.

(6) True Density of Hollow Glass Filler

The true density of the hollow glass filler was determined according to "Average True Particle Density of Hollow Microspheres" prescribed in ASTM D2840-69, by using a fully automated gas displacement pycnometer with a trade name of "ACCUPYC 1330 PYCNOMETER" available from Micromeritics (Norcross, Georgia).

[Preparation of Grip Composition]

According to the formulations shown in Tables 1 and 2, raw materials were kneaded with a Banbury mixer (material temperature: 80 to 150° C.) to prepare the outer layer rubber composition and the inner layer rubber composition.

TABLE 1

| Inner layer grip composition | | Parts by mass |
|---|---|---|
| Base rubber | HNBR | 100 |
| Crosslinking agent | Sulfur | 1.5 |
| Vulcanization accelerator | TBzTD | 3 |
| Vulcanization activator | Zinc oxide | 5 |
| Reinforcing material | Carbon | 5 |
| Foaming agent | Microballoons | 8 |
| Material hardness (JIS-A) | | 39 |

Materials used in Table 1 are shown below.

HNBR: hydrogenated acrylonitrile-butadiene rubber (Therban 3446 (amount of residual double bond: 4.0%, amount of acrylonitrile: 34.0 mass %)) available from Lanxess Corporation Sulfur: 5% oil treated sulfur fine powder (200 mesh) available from Tsurumi Chemical Industry Co., Ltd.

TBzTD: tetrabenzylthiuram disulfide (NOCCELER TBzTD) available from Ouchi Shinko Chemical Industry Co., Ltd.

Zinc oxide: Ginrei R available from Toho Zinc Co., Ltd.

Carbon black: SEAST SO available from Tokai Carbon Co., Ltd.

Microballoons: "Expancel 909-80" (resin capsules encapsulating a hydrocarbon having a low boiling point in a shell formed from a thermoplastic resin, volume average particle size: 18 μm to 24 μm, expansion starting temperature: 120° C. to 130° C.) available from Akzo Nobel Company

TABLE 2

| Outer layer grip composition | | Parts by mass |
|---|---|---|
| Base rubber | HXNBR | 100 |
| Crosslinking agent | Sulfur | 1.5 |
| Vulcanization accelerator | TBzTD | 3 |
| Vulcanization activator | Zinc peroxide | 5 |
| Reinforcing material | Carbon black | 5 |
| Antioxidant | TBTU | 1 |
| Resin | Rosin | 20 |
| Material hardness (JIS-A) | | 47 |

Materials used in Table 2 are shown below.

HXNBR: hydrogenated carboxyl-modified acrylonitrile-butadiene rubber (Therban XT VPKA 8889 (amount of residual double bond: 3.5%, amount of acrylonitrile: 33.0 mass %, amount of monomer having carboxyl group: 5.0 mass %)) available from Lanxess Corporation Sulfur: 5% oil treated sulfur fine powder (200 mesh) available from Tsurumi Chemical Industry Co., Ltd.

TBzTD: tetrabenzylthiuram disulfide (NOCCELER TBzTD) available from Ouchi Shinko Chemical Industry Co., Ltd.

Zinc peroxide: Struktol ZP 1014 (amount of zinc peroxide: 29 mass %) available from Struktol Company Carbon black: SEAST SO available from Tokai Carbon Co., Ltd.

TBTU: tributylthiourea (NOCRAC TBTU) available from Ouchi Shinko Chemical Industry Co., Ltd.

Rosin: HARITACK SE10 (hydrogenated rosin ester which is an ester compound obtained from a rosin and a polyhydric alcohol (including glycerin) in which the portion deriving from the rosin is hydrogenated, softening point: 78° C. to 87° C., acid value: 2 mgKOH/g to 10 mgKOH/g) available from Harima Chemicals Group, Inc.

[Preparation of Grip End Composition]

According to the formulations shown in Table 3, raw materials were kneaded with a Banbury mixer (material temperature: 80 to 150° C.) to prepare the grip end compositions.

Materials used in Table 3 are shown below.

HNBR: hydrogenated acrylonitrile-butadiene rubber (Therban 3446 (amount of residual double bond: 4.0%, amount of acrylonitrile: 34.0 mass %)) available from Lanxess Corporation Sulfur: 5% oil treated sulfur fine powder (200 mesh) available from Tsurumi Chemical Industry Co., Ltd.

TOT-N: tetrakis(2-ethylhexyl)thiuram disulfide (NOCCELER TOT-N) available from Ouchi Shinko Chemical Industry Co., Ltd.

Zinc oxide: Ginrei R available from Toho Zinc Co., Ltd.

TBTU: tributylthiourea (NOCRAC TBTU) available from Ouchi Shinko Chemical Industry Co., Ltd.

Carbon black: SEAST SO available from Tokai Carbon Co., Ltd.

Silica: ULTRASIL (registered trademark) VN3 GR available from Evonik Co., Ltd.

Hollow glass filler (1): Glass bubbles iM16K (true density: 0.46 g/cm$^3$, pressure resistance strength: 110 MPa, median particle size (d50): 20 μm) available from 3M Japan Ltd.

Hollow glass filler (2): Glass bubbles iM30K (true density: 0.60 g/cm$^3$, pressure resistance strength: 186 MPa, median particle size (d50): 16 μm) available from 3M Japan Ltd.

Hollow glass filler (3): Glass bubbles S60HS (true density: 0.60 g/cm$^3$, pressure resistance strength: 124 MPa, median particle size (d50): 24 μm) available from 3M Japan Ltd.

Hollow glass filler (4): Glass bubbles VS5500 (true density: 0.38 g/cm$^3$, pressure resistance strength: 38 MPa, median particle size (d50): 44 μm) available from 3M Japan Ltd.

Hollow glass filler (5): Glass bubbles S42XHS (true density: 0.42 g/cm$^3$, pressure resistance strength: 52 MPa, median particle size (d50): 22 μm) available from 3M Japan Ltd.

Microballoons: "Expancel 909-80" (resin capsules encapsulating a hydrocarbon having a low boiling point in a shell formed from a thermoplastic resin, volume average particle

TABLE 3

| Grip end composition | | Grip end 1 | Grip end 2 | Grip end 3 | Grip end 4 | Grip end 5 | Grip end 6 | Grip end 7 | Grip end 8 |
|---|---|---|---|---|---|---|---|---|---|
| Base rubber | HNBR | 100 | | | | | | | |
| Crosslinking agent | Sulfur | 1.5 | | | | | | | |
| Vulcanization accelerator | TOT-N | 5 | | | | | | | |
| Vulcanization activator | Zinc oxide | 3 | | | | | | | |
| Antioxidant | TBTU | 1 | | | | | | | |
| Reinforcing material | Carbon black | 3 | 3 | 3 | 3 | 3 | 40 | 3 | 5 |
| | Silica | — | — | — | — | — | — | 40 | — |
| | Hollow glass filler (1) | 40 | — | — | — | — | — | — | — |
| | Hollow glass filler (2) | — | 40 | — | — | — | — | — | — |
| | Hollow glass filler (3) | — | — | 40 | — | — | — | — | — |
| | Hollow glass filler (4) | — | — | — | 40 | — | — | — | — |
| | Hollow glass filler (5) | — | — | — | — | 40 | — | — | — |
| Foaming agent | Microballoons | — | — | — | — | — | — | — | 1.5 |
| Properties of reinforcing material | True density (g/cm$^3$) | 0.46 | 0.60 | 0.60 | 0.38 | 0.42 | 1.80 | 2.70 | — |
| | Pressure resistance strength (MPa) | 110 | 186 | 124 | 38 | 52 | — | — | — |
| | Median particle size (d50) (μm) | 20 | 16 | 24 | 44 | 22 | — | — | — |
| Properties of grip end | Hardness (A) | 70 | 69 | 70 | 62 | 63 | 70 | 73 | 56 |
| | Density (g/cm$^3$) | 0.84 | 0.87 | 0.86 | 1.06 | 1.08 | 1.12 | 1.15 | 0.83 |
| | Weight | 73 | 75 | 75 | 92 | 94 | 97 | 100 | 72 |
| | Abrasion resistance | 99 | 101 | 97 | 94 | 92 | 115 | 100 | 41 |

Formulation: parts by mass size: 18 μm to 24 μm, expansion starting temperature: 120° C. to 130° C.) available from Akzo Nobel Company

[Molding of Grip]

An unvulcanized rubber sheet having a fan shape was prepared from the outer layer rubber composition. The outer layer rubber sheet was formed with a fixed thickness. An unvulcanized rubber sheet having a rectangular shape was prepared from the inner layer rubber composition. The inner layer rubber sheet was formed with a thickness gradually getting thicker from one end toward the other end. The inner layer rubber sheet was wound around a mandrel, and the outer layer rubber sheet was laminated and wound around thereon to obtain a cylindrical grip body. In addition, the grip end composition was molded into a grip end shape by using a mold having a grip end shape to obtain an unvulcanized grip end.

The unvulcanized grip end was attached to the bat-side end of the obtained cylindrical grip body to obtain an unvulcanized grip. The obtained unvulcanized grip was charged into a mold provided with a groove pattern on the cavity surface thereof. Then, a heat treatment was performed at a mold temperature of 160° C. for 15 minutes to obtain golf club grips. The evaluation results regarding the properties of the grip ends are shown in Table 3. In Table 3, the mass of the grip end No. 7 was defined as an index of 100, and the mass of each grip end is a value represented by converting the mass of each grip end into this index.

The golf club grip according to the present invention which comprises a cylindrical grip body and a grip end attached to a bat-side end of the cylindrical grip body and in which the grip end comprises a base polymer and a hollow glass filler, has a reduced weight without substantially lowering abrasion resistance.

This application is based on Japanese patent application No. 2016-255777 filed on Dec. 28, 2016, the content of which is hereby incorporated by reference.

The invention claimed is:

1. A golf club grip comprising a cylindrical grip body and a grip end attached to a bat-side end of the cylindrical grip body, wherein the grip end comprises a base polymer containing an acrylonitrile-butadiene based rubber and a hollow glass filler, wherein the cylindrical grip body comprises a cylindrical inner layer, and wherein the cylindrical outer layer does not contain the hollow glass filler and a cylindrical outer layer covering the cylindrical inner layer.

2. The golf club grip according to claim 1, wherein the hollow glass filler has a pressure resistance strength of 100 MPa or more.

3. The golf club grip according to claim 2, wherein the hollow glass filler has a true density of 0.4 g/cm$^3$ or more and less than 0.8 g/cm$^3$.

4. The golf club grip according to claim 1, wherein the grip end comprises the hollow glass filler in an amount of 20 parts by mass or more and less than 60 parts by mass with respect to 100 parts by mass of the base polymer.

5. The golf club grip according to claim 1, wherein the cylindrical inner layer is a porous layer.

6. The golf club grip according to claim 5, wherein the porous layer is a foamed layer comprising a base rubber and microballoons.

7. The golf club grip according to claim 1, wherein the cylindrical outer layer comprises a base rubber and a resin having a softening point in a range from 5° C. to 120° C.

8. The golf club grip according to claim 1, wherein the hollow glass filler has a volume median particle size in a range from 16 μm to 65 μm.

9. The golf club grip according to claim 1, wherein the cylindrical outer layer comprises a base rubber containing a carboxyl-modified acrylonitrile-butadiene rubber or a carboxyl-modified hydrogenated acrylonitrile-butadiene rubber, and the grip end comprises a base polymer containing a hydrogenated acrylonitrile-butadiene rubber.

10. The golf club grip according to claim 1, wherein a grip end composition has a material hardness (JIS-A) in a range from 65 to 100, a grip composition constituting the cylindrical outer layer has a material hardness (JIS-A) in a range from 30 to 60.

11. The golf club according to claim 1, wherein a grip end composition has a material hardness (JIS-A) in a range from 65 to 100, a grip composition constituting the cylindrical outer layer has a material hardness (JIS-A) in a range from 30 to 60.

12. A golf club comprising a shaft, a head provided on one end of the shaft, and a golf club grip provided on another end of the shaft, wherein the golf club grip comprises a cylindrical grip body and a grip end attached to a bat-side end of the cylindrical grip body, and wherein the grip end comprises a base polymer containing an acrylonitrile-butadiene based rubber and a hollow glass filler, wherein the cylindrical grip body comprises a cylindrical inner layer and a cylindrical outer layer covering the cylindrical inner layer, and wherein the cylindrical outer layer does not contain the hollow glass filler.

13. The golf club according to claim 12, wherein the hollow glass filler has a pressure resistance strength of 100 MPa or more.

14. The golf club according to claim 13, wherein the hollow glass filler has a true density of 0.4 g/cm$^3$ or more and less than 0.8 g/cm$^3$.

15. The golf club according to claim 12, wherein the grip end comprises the hollow glass filler in an amount of 20 parts by mass or more and less than 60 parts by mass with respect to 100 parts by mass of the base polymer.

16. The golf club according to claim 12, wherein the cylindrical inner layer is a porous layer.

17. The golf club according to claim 16, wherein the porous layer is a foamed layer comprising a base rubber and microballoons.

18. The golf club according to claim 12, wherein the cylindrical outer layer comprises a base rubber and a resin having a softening point in a range from 5° C. to 120° C.

19. The golf club according to claim 12, wherein the hollow glass filler has a volume median particle size in a range from 16 μm to 65 μm.

20. The golf club according to claim 12, wherein the cylindrical outer layer comprises a base rubber containing a carboxyl-modified acrylonitrile-butadiene rubber or a carboxyl-modified hydrogenated acrylonitrile-butadiene rubber, and the grip end comprises a base polymer containing a hydrogenated acrylonitrile-butadiene rubber.

* * * * *